US005975638A

United States Patent [19]

Schreiner

[11] Patent Number: 5,975,638

[45] Date of Patent: Nov. 2, 1999

[54] PILLOW FOR SLEEPING UPRIGHT IN A CHAIR

[76] Inventor: Kevin E. Schreiner, 812 E. 4th St., Gillette, Wyo. 82716

[21] Appl. No.: 09/232,967

[22] Filed: Jan. 15, 1999

Related U.S. Application Data

[63] Continuation-in-part of application No. 09/098,007, Jun. 15, 1998, abandoned.

[51] Int. Cl.[6] ..... A47C 1/10

[52] U.S. Cl. ..... 297/398; 297/392; 297/228.13; 297/220; 297/DIG. 6

[58] Field of Search ..... 297/DIG. 6, 393, 297/392, 391, 395, 397, 228.13, 220; 5/636, 637, 643, 652, 922

[56] References Cited

U.S. PATENT DOCUMENTS

| | | | |
|---|---|---|---|
| 2,464,435 | 3/1949 | Conradt | 297/397 |
| 3,285,658 | 11/1966 | Cleveland | 297/392 X |
| 3,608,964 | 9/1971 | Earl | 297/397 |
| 4,550,458 | 11/1985 | Fione | 297/393 X |
| 4,679,263 | 7/1987 | Honer | 297/393 X |
| 4,991,222 | 2/1991 | Nixdorf | 297/391 X |
| 5,154,477 | 10/1992 | Lacy | 297/397 |
| 5,613,736 | 3/1997 | Schaked et al. | 297/397 |
| 5,868,471 | 2/1999 | Graham et al. | 297/391 X |

*Primary Examiner*—Milton Nelson, Jr.
*Attorney, Agent, or Firm*—Joseph F. Long

[57] ABSTRACT

A dual unit to gently and user adjustably support a user's head from slumping either too much forward or too much to either side while allowing proper air circulation for user comfort when the user is in an upright position with the unit releaseably held to a chair back is disclosed.

3 Claims, 4 Drawing Sheets

PILLOW FOR SLEEPING UPRIGHT IN A CHAIR

This application is a continuation-in-part of Ser. No. 09/098,007, filed Jun. 15, 1998, and entitled "A Pillow for Sleeping Upright in a Chair" (now abandoned).

BACKGROUND OF THE INVENTION

There is a large amount of prior art indicating the perceived need for a properly designed portable support pillow for one to sleep in an upright position while traveling and, particularly with asthma sufferers while at home. It is known in the Medical profession that sound healthful sleep in the upright position requires comfortable support of the head and neck to prevent undue lateral or forward or backward flexure. Since coach class airline seats only recline about four inches prevention of undue forward flexure is a necessity in a properly designed portable travel pillow. To allow for user comfort in use side support for a user's head should allow for air circulation around the ears and neck and minimize perspiration of the head. The pillow should have a washable covering, be adaptable to fit many different styles of airline, bus, train, or auto seats as well as to fit many living room chairs and should be foldable to a relatively small package for easy portability.

The subject invention fulfills all these needs. We find no prior art to fulfill all these needs.

SUMMARY OF THE INVENTION

The invention encompasses an interacting dual unit. The first unit being simply a cloth either of a loop material or having a loop material that may be part of a hook and loop fastener that may be draped over and fastened to a chair back to hold a pillow at the proper height for user comfort as the user leans back to push the pillow which is equipped with a hook strip against the cloth. In order to comfortably support a users head when the user is an upright position and comfortably prevent the user's head from slumping too far to either side or too far forward the pillow is formed with a foamed material over a rigid backing with foldable ends with a limited outward travel and a chin strap to allow the user the user to pull the foldable foam covered ends to a comfortable support position. The foldable ends may be pulled inward to cradle a users head but are limited to about a ninety degree outward travel to allow a users head to be movable but prevented from falling too far sideways during sleep.

DESCRIPTION OF THE INVENTION

Figure 1:
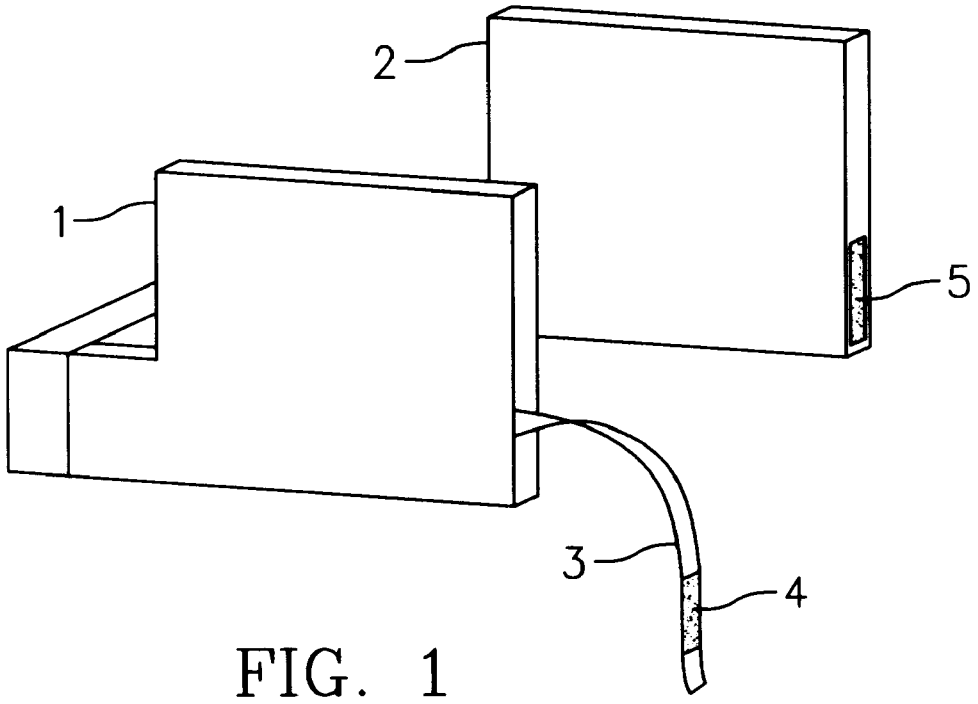
FIG. 1 shows a three dimensional front and side view of the assembled pillow.

The invention may best be described from the drawings. In FIG. 1 a three dimensional view of the assembled pillow unit is shown. Side 1 and side 2 are formed with a rigid interior frame and blocks of spongy material 11, and 12 FIG. 6 inside a cloth covering, 14, FIG. 5. A user's head may be supported from sideways motion between sides 1 and 2 and prevented from falling forward using chin strap 3 with hook and loop fasteners 4 and 5.

Figure 2:
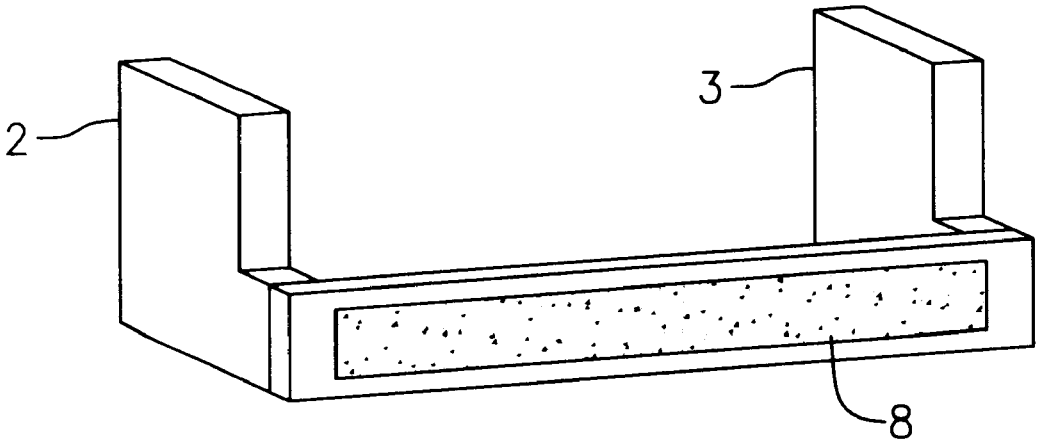
FIG. 2 shows a rear view of the assembled pillow.
Figure 3:
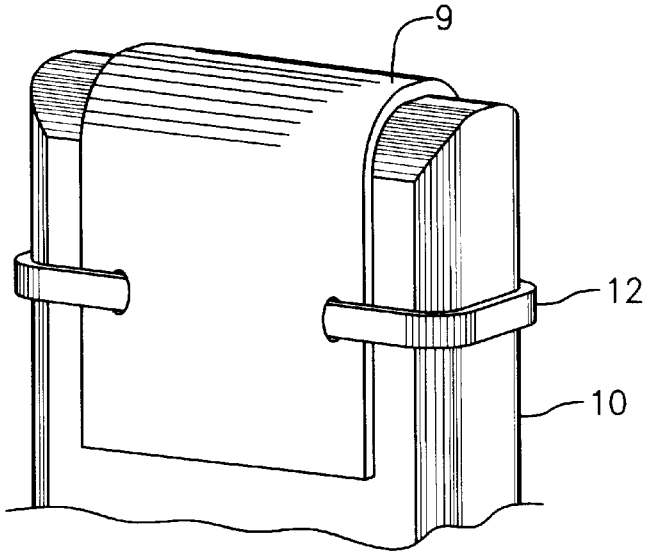
FIG. 3 shows a front view of material secured to a seat back that may releaseably hold the assembled pillow.
Figure 5:
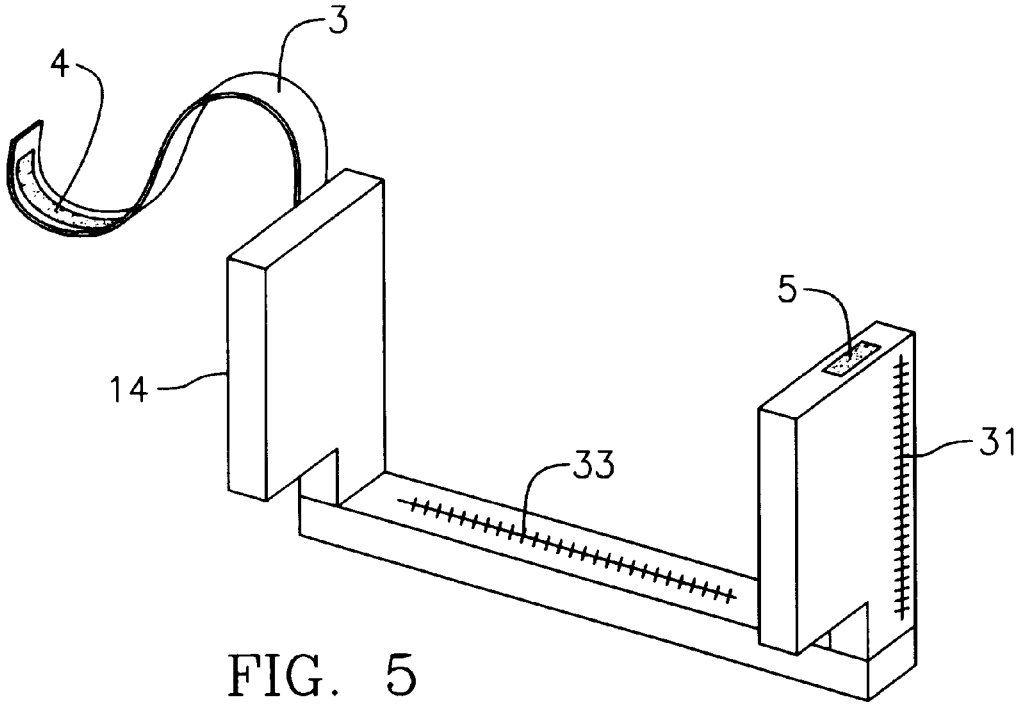
FIG. 5 shows the pillow frame covering.

In FIG. 2 a back perspective view is shown with one half of a hook and loop fastener 8 on pillow covering 14, FIG. 5, said fastener 8 interacts with loop material 9, FIG. 3, to prevent the assembled pillow from falling forward with normal forces after the user pushes the pillow back against loop material 9 at a position that comfortably fits the user's height.

In FIG. 3 one half of a hook and loop fastener is shown in the form of cloth 9, preferably of loop material and sized to be a minimum of about six inches wide and to drape downward over chair back 10 a minimum of about eight inches but preferably at least 12 inches. Stabilizer strap 12 preferably goes through cloth 9 as shown and fastens in back of chair back 10 over a beginning end of cloth 9. (not shown)

Figure 4:
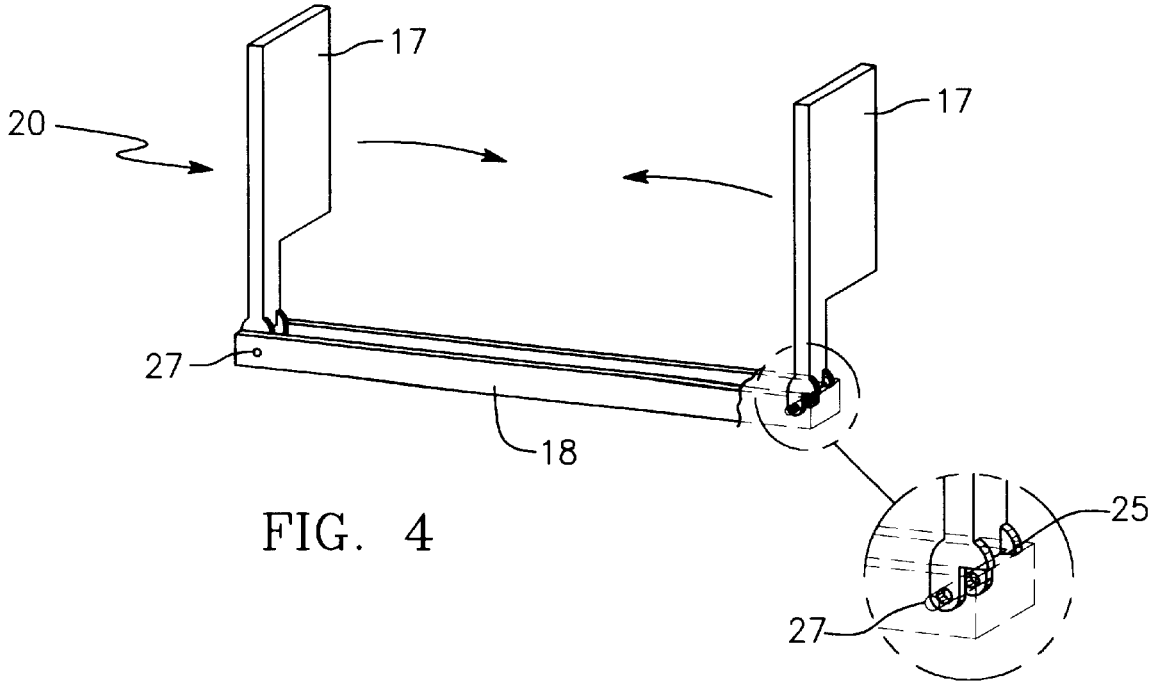
FIG. 4 shows a three dimensional view of the hinged pillow frame.

In FIG. 4 pillow frame 20 is shown. Frame 20 is preferably made of a tough but rigid plastic such as Nylon and may be from about one eigth to three eighths of an inch thick. Ell shaped ends 17 may be hinged to center section 18 by snap in pivot pins 27 to movably connect sides 17 to frame center 18. Stop projections 25 prevent outward rotation of sides 17 to about a ninety degree angle. Other hinge type connectors would be within the purvey of the invention but to allow proper operation to cradle a users head outward rotation of the sides 17 would necessarily be limited. The center section may be less than four inches wide and less than about twelve inches long. The ell shaped end sections 17 may be envisioned as an approximately a hinged two inch by two inch segment integrally formed with a segment that is a minimum of two inches by six inches by a minimum of about one eigth inch thick. Preferably sizing is such as to allow folding the final product to a maximum size of about an eight by twelve by four inch pillow after completing the assembly as outlined in FIGS. 5, 6, and 7. This size allows transportation in briefcase or handbag.

Figure 6:
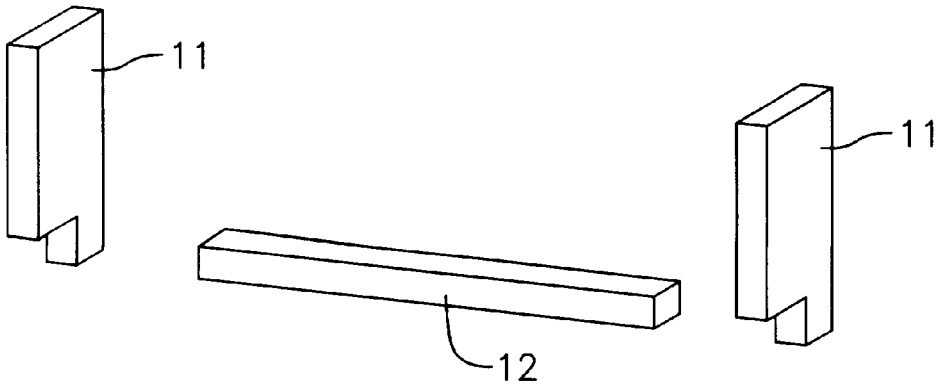
FIG. 6 shows loose foam blocks sized to fit into the pillow frame covering.

FIG. 5 shows a cloth bag 14 with a lengthwise zipper closures 33 and 31 with said bag 14 shaped to fit over frame 20, FIG. 4 and sized to allow sliding spongy foam blocks 11 and 12, FIG. 6 into foldable ends 17 over center section 18 of the frame 20. Chin strap 3 and hook and loop fastener 4 and 5 are as discussed under FIG. 1.

FIG. 6 shows spongy foam blocks 11 and 12 sized to fit into cloth bag 14, FIG. 5 and over frame 20, FIG. 4. Foam block 12 that fits in bag 14 and in back of a user's head is preferably a minimum of about an inch and one half thick and foam blocks 11 that fit into bag 14 and cradle a user's face are preferably about an inch and one half thick.

Although spongy foam blocks are preferably many other paddings including cotton, feathers, plastic particles, and for more expensive pillows goose Down are equally useable.

Figure 7:
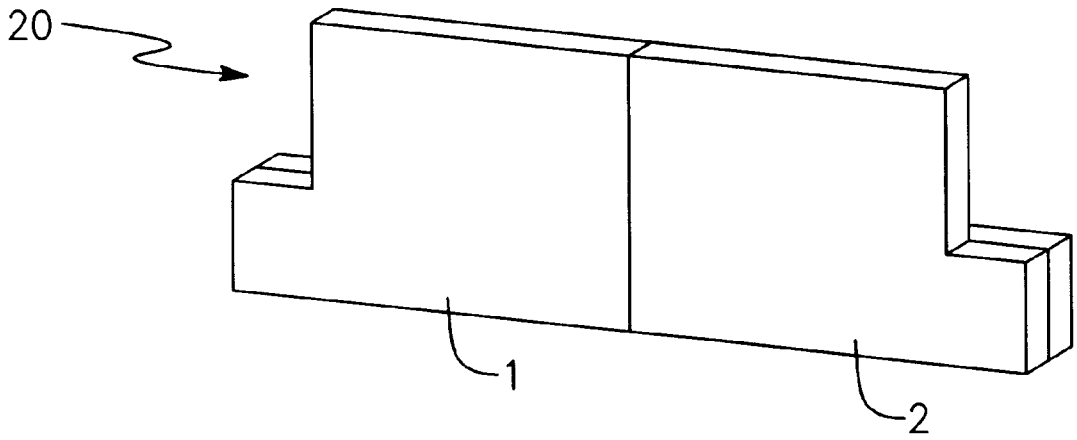
FIG. 7 shows the pillow in folded position for transport.

FIG. 7 shows sides 1 and 2 of pillow 20 folded inward for transportation. In some embodiments the sides may overlap instead of folding neatly together as shown.

What is claimed is:

1. A pillow for sleeping upright comprising:

a) A foldable rigid frame with a center section a minimum of eight inches long and two inches wide with a first ell shaped segment with a first hinge means foldable inward and limited to about ninety degree outward movement on a first end of said center section and a second ell shaped segment with a second hinge means foldable inward and limited to about a ninety degree outward movement on a second end of said center section; each of said ell shaped segments having one leg of said ell shaped segment a minimum of two inches wide and a minimum of two inches long and a second leg a minimum of six inches long and a minimum of two inches wide, b) a cloth cover with zipper closures fitted over said foldable frame with sufficient space in said cloth cover to allow inserting a piece of a spongy foam material a minimum of one and one half inches thick to cover each of said ell shaped segments and a third piece of a spongy foam material a minimum of three inches wide and one and a half inches thick to cover said center section of said foldable frame;

c) a hook side of a hook and loop closure material applied to a portion of said cloth cover covering a back part of said center section of said foldable frame;

d) a stabilizing strap and said loop closure material; said loop closure material being sized to drape down a minimum of eight inches over a chair back and being fastenable to said chair back with said stabilizing strap thereby allowing said cloth covered frame to be removably held against said loop closure material by interaction of said hook material on said cloth covered frame and said loop closure material;

e) a chin strap means fastened at one end to a first end of said cloth on said cloth covered frame and removably fastenable in front of a user's chin to a second end of said cloth on said cloth covered frame.

2. A pillow for sleeping upright comprising:

a) A foldable rigid frame with a center section a minimum of eight inches long and a minimum of about two inches wide with a first ell shaped segment, said first ell shaped segment hingeably attached to a first end of said center section and foldable inward and limited to about ninety degree outward movement on a first end of said center section and a second ell shaped segment, said second ell shaped segment hingeably attached to a second end of said center section and foldable inward and limited to about a ninety degree outward movement on a second end of said center section; each of said ell shaped segments having one leg of said ell shaped segment a minimum of two inches wide and a minimum of two inches long and a second leg a minimum of six inches long and a minimum of two inches wide, b) a cloth cover and padding material, said cloth cover having buttonable closures and being fittable over said foldable frame with sufficient space in said cloth cover to allow inserting said padding material;

c) a hook side of a hook and loop closure material applied to a portion of said cloth cover that covers a back part of said center section of said foldable frame, d) a stabilizing strap and said loop closure material; said loop closure material being sized to drape down a minimum of eight inches over a chair back and being fastenable to said chair back with said stabilizing strap thereby allowing said cloth covered frame to be removably held against said loop closure material by interaction of said hook material on said cloth covered frame and said loop closure material;

e) a chin strap means fastened at one end to a first end of said cloth on said cloth covered frame and removably fastenable in front of a user's chin to a second end of said cloth on said cloth covered frame.

3. A pillow for sleeping upright comprising:

a) A foldable rigid frame with a center section a minimum of eight inches long and two inches wide with end segments hingeably attached on each end of said center section and foldable inward and limited to about ninety degree outward movement; said end segments being shaped to allow an air space on a user's neck below a back part of said user's head and to prevent a user's face from falling sideways;

b) a cloth cover and padding material, said cloth cover having buttonable closures and being fittable over said foldable frame with sufficient space in said cloth cover to allow inserting said padding material;

c) a hook side of a hook and loop closure material applied to a portion of said cloth cover that covers a back part of said center section of said foldable frame;

d) a stabilizing strap and said loop closure material; said loop closure material being a minimum of six inches wide and sized to drape down a minimum of eight inches over a chair back and being fastenable to said chair back with said stabilizing strap thereby allowing said cloth covered frame to be removably held against said loop closure material by interaction of said hook material on said cloth covered frame and said loop closure material;

e) a chin strap means fastened at one end to a first end of said cloth on said cloth covered frame and removably fastenable in front of a user's chin to a second end of said cloth on said cloth covered frame.

* * * * *